US007841970B2

(12) United States Patent
Striar et al.

(10) Patent No.: US 7,841,970 B2
(45) Date of Patent: Nov. 30, 2010

(54) VARIABLE WEIGHT DEVICE

(75) Inventors: Michael Striar, 41 Montvale Rd., Newton Center, MA (US) 02459; Stephen Charles Messer, Durham, NC (US)

(73) Assignee: Michael Striar, Newton Center, MA (US)

( * ) Notice: Subject to any disclaimer, the term of this patent is extended or adjusted under 35 U.S.C. 154(b) by 409 days.

(21) Appl. No.: 11/880,470

(22) Filed: Jul. 20, 2007

(65) Prior Publication Data

US 2008/0051262 A1 Feb. 28, 2008

Related U.S. Application Data

(60) Provisional application No. 60/834,088, filed on Jul. 28, 2006.

(51) Int. Cl.
*A63B 21/06* (2006.01)
*A63B 21/062* (2006.01)

(52) U.S. Cl. ..... 482/93; 482/99

(58) Field of Classification Search ..... 482/93, 482/99, 102, 107, 115, 116, 120, 127, 129; 242/379, 379.2, 384.7, 385.4, 396.1
See application file for complete search history.

(56) References Cited

U.S. PATENT DOCUMENTS

| | | | | |
|---|---|---|---|---|
| 2,593,018 | A * | 4/1952 | Fendrock | 24/71.1 |
| 3,397,884 | A * | 8/1968 | Blasi | 482/91 |
| 3,424,422 | A * | 1/1969 | George | 248/561 |
| 4,174,832 | A * | 11/1979 | Thompson | 482/120 |
| 4,235,437 | A | 11/1980 | Ruis et al. | |
| 4,518,163 | A | 5/1985 | Bruder | |
| 4,531,727 | A | 7/1985 | Pitre | |
| 4,569,105 | A | 2/1986 | Weider | |
| 4,627,615 | A | 12/1986 | Nurkowski | |
| 4,765,613 | A | 8/1988 | Voris | |
| 4,832,334 | A | 5/1989 | Mullen | |
| 4,890,831 | A | 1/1990 | Craig | |
| 5,029,849 | A | 7/1991 | Nurkowski | |
| 5,037,089 | A | 8/1991 | Spagnuolo et al. | |

(Continued)

FOREIGN PATENT DOCUMENTS

EP 0566108 A1 10/1993

(Continued)

OTHER PUBLICATIONS

"Weight Lifting Powerlifting Chains,"APT Pro Weight Lifting Gear . . . , http://www.prowriststraps.com/in/sdetail/48001?xtr=criticalbench, downloaded Jul. 7, 2006, pp. 1-7.

(Continued)

*Primary Examiner*—Loan Thanh
*Assistant Examiner*—Allana Lewin
(74) *Attorney, Agent, or Firm*—Hamilton, Brook, Smith & Reynolds, P.C.

(57) ABSTRACT

A variable weight device for an exercise device including a housing. A flexible length of cable can be stored within the housing. The length of the cable extending from the housing can be adjustable. A length of flexible weight can be secured to one of the housing and the cable.

11 Claims, 13 Drawing Sheets

U.S. PATENT DOCUMENTS

| | | | | |
|---|---|---|---|---|
| 5,125,649 | A | 6/1992 | Fuller | |
| 5,152,523 | A | 10/1992 | Keen | |
| 5,284,464 | A * | 2/1994 | Lee et al. | 482/121 |
| 5,328,433 | A | 7/1994 | Berman | |
| 5,346,448 | A | 9/1994 | Sollo | |
| 5,891,004 | A | 4/1999 | Berry | |
| 6,123,649 | A * | 9/2000 | Lee et al. | 482/54 |
| 6,149,559 | A * | 11/2000 | Mackey | 482/124 |
| 6,213,421 | B1 * | 4/2001 | Franklin | 242/384.7 |
| 6,243,921 | B1 * | 6/2001 | Chang | 24/3.13 |
| 6,336,894 | B1 | 1/2002 | Kestila | |
| 6,350,220 | B1 | 2/2002 | Milburn et al. | |
| 6,659,922 | B1 * | 12/2003 | Yu | 482/127 |
| 7,150,682 | B2 * | 12/2006 | Varner | 473/257 |
| 2004/0009854 | A1 | 1/2004 | Shiang et al. | |
| 2004/0254050 | A1 | 12/2004 | Morgan | |
| 2005/0164853 | A1 | 7/2005 | Naidus | |
| 2006/0035770 | A1 * | 2/2006 | Crowson et al. | 482/129 |
| 2006/0046911 | A1 | 3/2006 | Leight | |
| 2006/0166797 | A1 * | 7/2006 | Hamer | 482/121 |
| 2007/0199635 | A1 * | 8/2007 | McCauley et al. | 152/217 |

FOREIGN PATENT DOCUMENTS

| | | | |
|---|---|---|---|
| GB | 2 086 738 | A | 5/1982 |
| GB | 2 124 916 | A | 2/1984 |
| NL | 1004833 | C1 | 6/1998 |

OTHER PUBLICATIONS

"Lifting Chains 3 Pack—MegaTuff Lifting Chain Pack," http://www.megafitness.com, downloaded Jul. 7, 2006, pp. 1-4.

"Benchpress With Chains," http://www.weightliftingdiscussion.com/chains.html, downloaded Jul. 7, 2006, pp. 1-2.

Schultz, Curtis, "Banging Triceps for a Bigger Bench Press!" http://www.bodybuilding.com/fun/schultz38.htm, downloaded Jul. 7, 2006, pp. 1-6.

* cited by examiner

VARIABLE WEIGHT DEVICE

RELATED APPLICATION

This application claims the benefit of U.S. Provisional Application No. 60/834,088, filed on Jul. 28, 2006. The entire teachings of the above application are incorporated herein by reference.

BACKGROUND

Individuals that weight train sometimes desire to perform exercises in which the weight that is lifted increases as the weight is lifted upwardly, and decreases as the weight is lowered. One common method of obtaining such a variable weight is to wrap lengths of chain around the ends of a weight lifting bar. As the bar is lifted, chain links are lifted from the ground, increasing the total weight that is lifted, and as the bar is lowered, chain links are lowered onto the ground, decreasing the total lifted weight. A drawback of such a method, is that it is unwieldy.

SUMMARY

The present invention can provide a variable, flexible or linked weight apparatus, device or system, that allows variable weight exercises to be performed in an easy and adjustable manner.

The present invention can provide a variable weight device for an exercise device which can include a housing. A flexible length of cable can be stored within the housing. The length of the cable that extends from the housing can be adjustable. A length of flexible weight can be secured to one of the housing and the cable.

In particular embodiments, a securement arrangement can secure the variable weight device to the exercise device. The securement arrangement can includes an opening through the housing. In some embodiments, the securement arrangement can include a spring loaded collar. An adjustable cable mechanism which includes a lockable spring loaded spool can store a supply of the cable. A locking mechanism can releasably lock the spool. The housing can have an opening above the spool for securing the housing to a weight bar. The opening can include a spring loaded collar. The cable can include adjustment markings. The length of flexible weight can be chain.

The present invention can also provide a variable weight device for an exercise device which can include a housing for securing to the exercise device. The housing can contain an adjustment mechanism. A length of flexible weight can be connected to the housing and can be lockably adjustable relative to the exercise device by the adjustment mechanism to provide different starting points for incrementally lifting the length of flexible weight for providing increasing and decreasing weight throughout a range of motion.

The present invention can also provide a variable weight device for an exercise device which can include a securement arrangement for securing to a structure on the exercise device. An adjustable cable mechanism can be connected to the securement arrangement. The adjustable cable mechanism can have a housing containing an adjustable retractable cable capable of being adjustably locked to adjust the cable that extends from the housing to a desired length. A length of flexible weight can be connected to the adjustable cable mechanism. Adjustment of the length of the cable extending from the housing can adjust the position of the length of the flexible weight.

The present invention can also provide a variable weight device for an exercise device including a housing for securement to the exercise device. A securement arrangement having a spring loaded collar can be within the housing for securing the variable weight device to the exercise device. A length of flexible weight can be connected to the housing.

The present invention can also provide an exercise machine including a frame and an exercise interface member that is movable by a user performing exercises. A component that is moveably connected to the frame can move in a fixed path with movement of the exercise interface member. A length of flexible weight can be secured to the component in a manner where the length of flexible weight is lifted and lowered by movement of the component for providing increasing and decreasing weight throughout a range of motion.

The present invention can also provide a method of adjusting a length of flexible weight on an exercise device. Flexible cable can be stored within a housing. A length of the cable can extend from the housing, with the length being adjustable. A length of flexible weight can be secured to one of the housing and the cable. The length of the cable can be adjusted to adjust the position of the length of the flexible weight.

In particular embodiments, the housing can be secured to the exercise device with a securement arrangement. The housing can be secured to the exercise device through an opening through the housing. The variable weight device can be secured to the exercise device with a spring loaded collar. A supply of the cable can be stored on a lockable spring loaded spool of an adjustable cable mechanism. The spool can be releasably locked with a locking mechanism. The housing can be secured to a weight bar through an opening in the housing above the spool. The opening can include a spring loaded collar. The cable can be adjusted according to adjustment markings on the cable. The length of flexible weight can be chain.

The present invention can also provide a method of adjusting a length of flexible weight on an exercise device including securing a housing to the exercise device. The length of flexible weight can be connected to the housing. The housing can contain an adjustment mechanism. The position of the length of flexible weight can be lockably adjusted relative to the exercise device to provide different starting points for incrementally lifting the length of flexible weight for providing increasing and decreasing weight throughout a range of motion.

The present invention can also include a method of providing variable weight on an exercise device. The housing can be secured to the exercise device with a securement arrangement. The securement arrangement can include a spring loaded collar within the housing. A length of flexible weight can be connected to the housing.

The present invention can also provide a method of adjusting a variable weight device on an exercise device including securing the variable weight device to a structure on the exercise device with the securement arrangement. An adjustable cable mechanism can be connected to the securement arrangement. The adjustable cable mechanism can have a housing containing an adjustable retractable cable capable of being adjustably locked to adjust the cable extending from the housing to a desired length. A length of flexible weight can be connected to the adjustable cable mechanism. The length of cable extending from the housing can be adjusted to adjust the position of the length of flexible weight.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
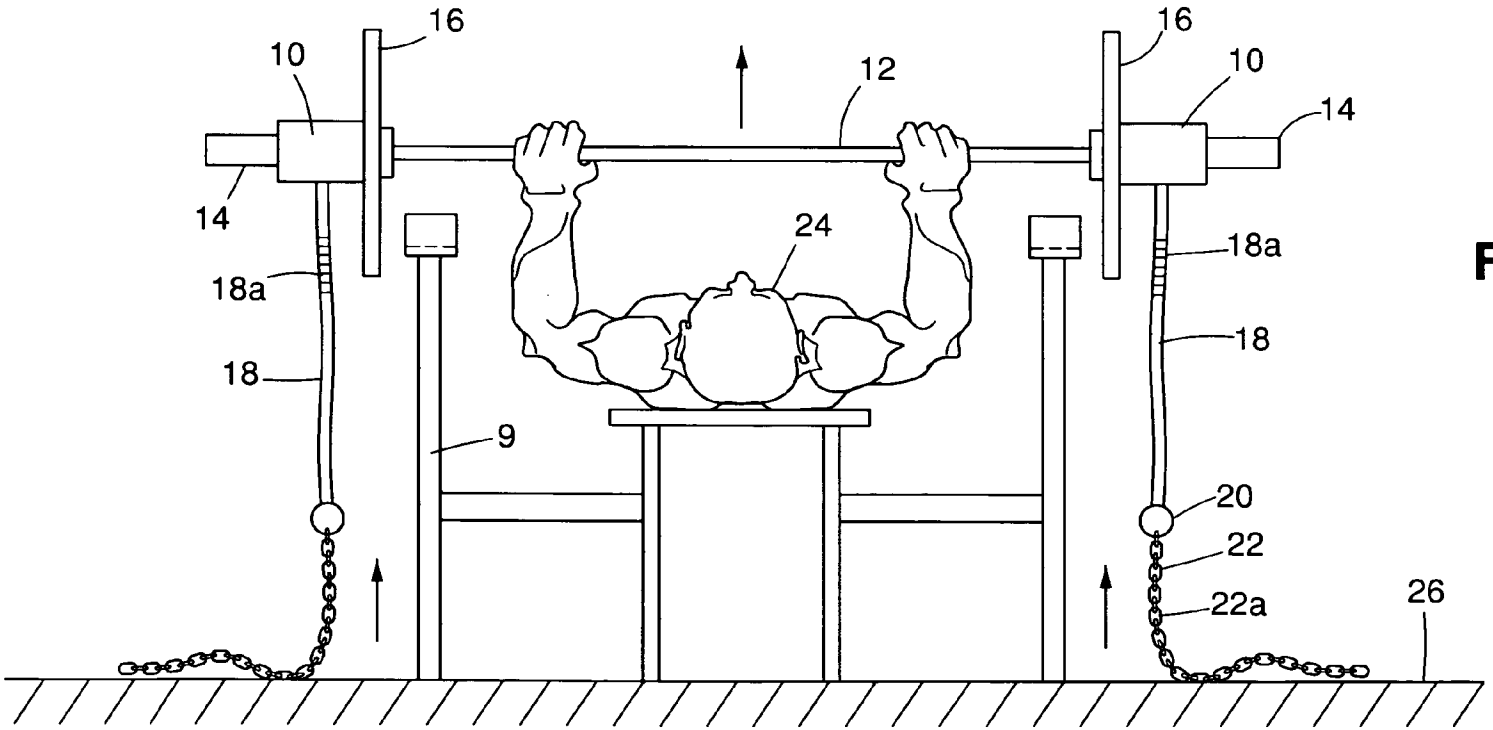
FIG. 1 is a rear view of a user performing a bench press exercise with an embodiment of a variable weight device.

FIG. 1 shows an example of a user 24 performing a bench press exercise in accordance with an embodiment in the present invention. Variable, flexible or linked weight systems, apparatuses or devices 10, can be secured on opposite end sleeves 14 of a weight lifting or training exercise bar or device 12, and against the plate weights 16. An adjustable length cable 18 can extend from each device 10, terminating in a ring 20, to which a length of flexible weight or chain 22 can be attached. As the user 24 performs his exercises, the chain 22 incrementally lifts from the floor or ground 26, thereby increasing the total lifted weight as the bar 12 is moved upwardly, and decreasing the total lifted weight as the bar 12 moves downwardly. The length of the cable 18 can be adjusted to provide the desired weight characteristics, or to adjust to different starting heights at which the lifted weight begins to increase. The cable 18 can have markings 18*a* to aid in evenly adjusting the starting height or point at both ends of the bar 12. The markings can be graduated and similar to a tape measure or can have color coded markings. In some embodiments, the markings can indicate the weight increase profile. In an example, the cables 18 can be adjusted so that the user 24 can lift the bar 12 a desired distance before the chains 22 begin to lift from the ground 26. Alternatively, the cables 18 can be adjusted to begin to lift the chains 22 immediately at the beginning of the lifting motion of the bar 12. In addition, the length of the cables 18 can be adjusted to increase or decrease the amount of chain 22 and weight that is initially lifted at the start of the exercise. This can allow the user 24 to vary the starting weight of an exercise within a certain range without adding or removing plate weights 16.

Figure 2:
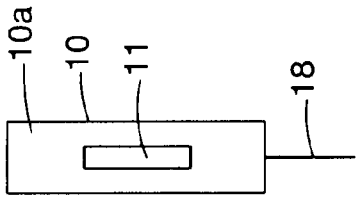
FIG. 2 is a side view of an embodiment of a housing of a variable weight device.

The size and configuration of the chain 22 and the links 22*a* of the chain 22 can be chosen to provide the desired added weight and weight increase/decrease profile, for example, a gradual smooth incremental increase/decrease, or rapid incremental increase/decrease, which can be in large increments. For example, depending upon the situation at hand, the length of the chain 22 as well as the size, shape and weight of the links 22*a* can be varied. In some embodiments, the links 22*a* can be triangular, circular, flattened, different sizes in the same chain 22 etc. In addition, some links 22*a* can nest within each other or stack together. The flexible weight or chain 22 can also include linked weights that are connected or linked together by cords, ropes, chain or sliding rods or pieces. The flexible weight or chain 22 can be elongate or squat, depending upon the configuration of the links 22*a*. Also, the increase/decrease in weight provided by chain 22 can be linear, or nonlinear, depending upon the configuration of the chain 22. Furthermore, the chain 22 can be replaced with a nonlinked flexible weight, for example, a flexible tube filled with weighted particles, or a weighted flexible ribbon or rope. As a result, the flexible weight can have weight or weights that are laterally moveable relative to portions thereof, or to each other if there is a series of links 22*a* or weights. Referring to FIG. 2, the variable weight device 10 can be disc shaped and can have handles 11.

Figure 3:
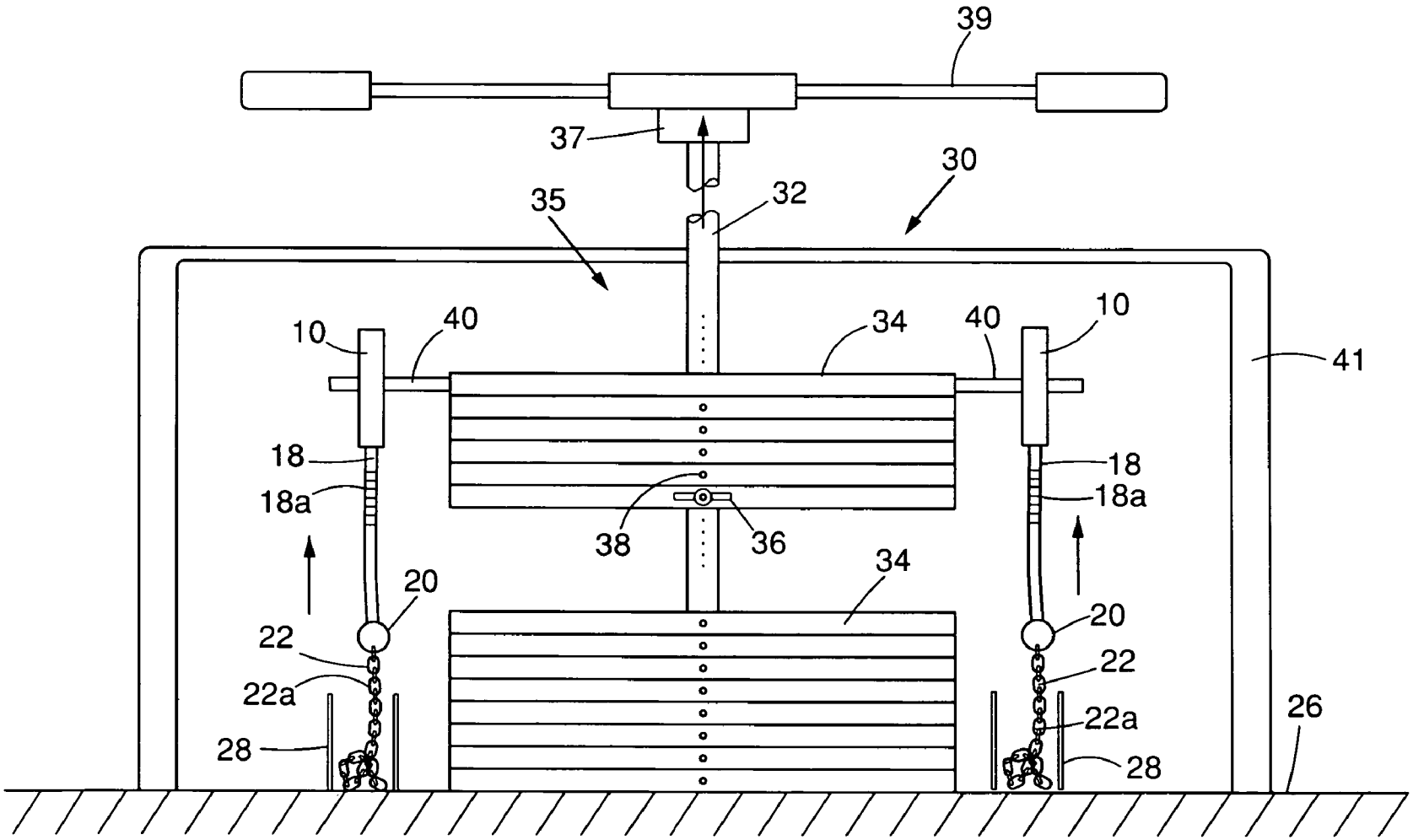
FIG. 3 depicts a portion of a plate type weight machine having an embodiment of a variable weight device.

Referring to FIG. 3, variable weight devices 10 can be added to a plate type exercise or weight machine or device 30, by adapters 40 or at other suitable structures, to provide adjustable and desired weight increase/decrease characteristics during an exercise range of motion. The exercise machine 30 can have a component such as a plate mechanism 35 that is moveably mounted to a frame 41 and moves in a fixed path up and down, relative to the frame 41, to which the variable weight devices 10 can be connected. The plate mechanism 35 can be lifted and lowered by an exercise interface component or member 39 that is moveably mounted to the frame 41, for example, a bench press handle as shown. The interface member 39 can be connected to the plate mechanism 35 by an appropriate coupling mechanism 37. The interface member 39 can move in a fixed path up and down relative to the frame 41. The starting point of the weight increase can be adjusted by adjusting length of the cable 18 extending from device 10. A pin 36 can be inserted through a hole 38 in a selected plate 34 of the plate mechanism 35 to secure a desired number of plates 34 and associated weight to a shaft 32 for lifting by the user 24. FIG. 3 depicts two variable weight devices 10, however, in some embodiments, one may be sufficient. The flexible weight or chain 22 can be stored in a container 28, such as a tube, from which the chain 22 is lifted out of and lowered back into. The location of the variable weight device 10 can be varied depending upon the configuration of the exercise machine 30 and the situation at hand. In some embodiments, a single variable weight device 10 can be centrally positioned. In addition, the variable weight device 10 can be connected to other locations or mechanisms on the exercise machine 30 that are lifted and lowered, such as the handles 39. The use of pulleys can allow the variable weight device 10 to be connected to components on exercise machines that move horizontally, or at an angle. Some plate type exercise machines 30 have end sleeves 14 to which the variable weight system device 10 can be secured. The variable weight device 10 can also be secured to exercise machines where free weight plates are added, for example to a leg press sled, or other suitable machines having components that can move in a fixed path, including those without weights. Exercise machine 30 can have other exercise interface members 39 such as handles attached to cables and pulleys. The variable weight device 10 can be connected to members or components that move in a variable path in some embodiments.

Figure 5:
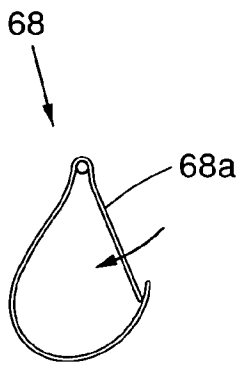
FIG. 5 is a side view of a spring loaded clip.
Figure 4:
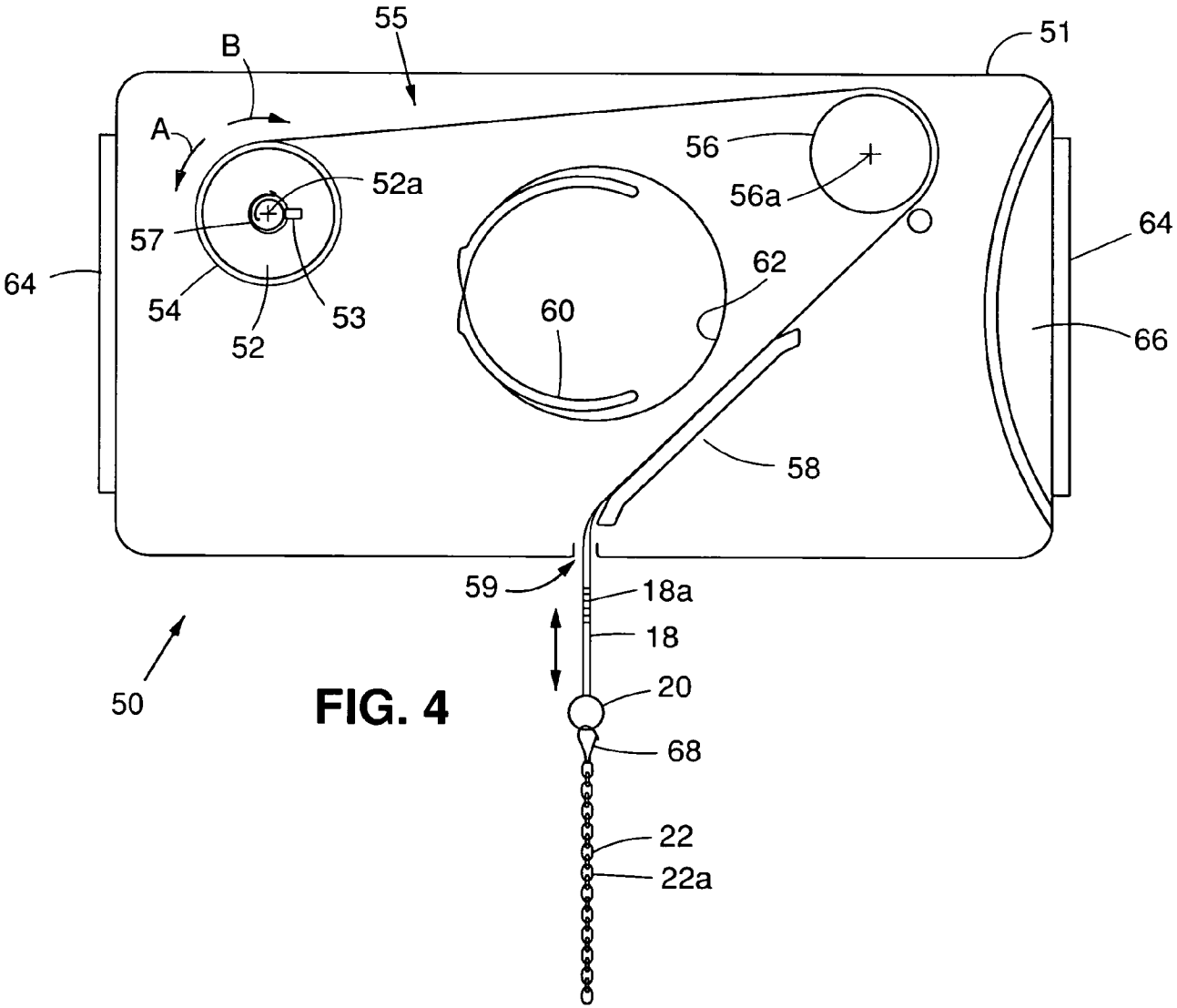
FIG. 4 is a schematic drawing of an embodiment of a variable weight device.

Referring to the embodiment shown in FIGS. 4 and 5, variable, flexible or linked weight system, apparatus or device 50, can have cuff, collar or housing 51 of any suitable shape, for example, generally rectangular as shown. The housing 51 can have a hole or opening 62 for engaging the end sleeve 14 of a weight training bar 12, or a suitable structure on an exercise device. The hole 62 can include a spring loaded securement member, device, clamp, collar, or sleeve 60, for releasably gripping and securing the housing 51 to the end sleeve 14. The diameter of the securement sleeve 60 can be widened by pressing on spring retractor members, buttons or levers 64, to allow the housing 51 to be positioned on end sleeve 14 for locking weights 16 in place, or for being removed from the end sleeve 14. In the embodiment shown, two buttons 64 can be simultaneously pressed for widening the securement sleeve 60, and then released to allow the securement sleeve 60 to resiliently narrow for resilient gripping. In some embodiments, one button 64 or member can be employed. The housing 51 can be plastic, or if desired, can be other suitable materials such as composites, or metal.

A lockable cable adjustment mechanism 55 can be housed within the housing 51 for adjusting the length of the cable 18 outside the housing 51 to the desired length. The cable mechanism 55 can include a supply spool 52 having a supply 54 of cable 18, an idler pulley 56 rotatable about an axis 56*a*, a guide channel 58 and an adjustment button or member 66. The supply spool 52 can be rotatably lockable about axis 52*a* by a locking member or mechanism 53, and can be resiliently spring loaded by a spring mechanism 57, in the direction A, for example, counter clockwise. Pressing the adjustment button 66 unlocks locking mechanism 53 and allows the cable 18 to be pulled under tension from the housing 51 through opening 59 in which supply spool 52 rotates in the direction B, for example, clockwise, under resilient spring tension by the spring mechanism 57. Once the cable 18 is at the desired position or length to position chain 22 at the desired location, releasing the adjustment button 66 then locks the position of the supply spool 52 in place with locking mechanism 53. Alternatively, the length of the cable 18 extending from housing 51 can be shortened by pressing the adjustment button 66 to unlock the supply spool 52, and allowing the spring tension of the spring mechanism 57 to rotate the supply spool 52 in the direction A to roll cable 18 onto the supply spool 52 and shorten the length of the cable 18. Once the cable 18 is at the desired length to position the chain 22 at the desired location, release of the adjustment button 66 can then lock the supply spool 52 in the desired position. Markings 18*a* can visually aid in the desired adjustment. Some embodiments of the cable mechanism 55 can have preset adjustment points for the cable 18. The cable 18 can be round, or can be a flat strap.

The flexible weight or chain 22 can be secured to the cable 18 by a spring loaded clip 68 having a spring loaded arm 68*a* (FIG. 5), which can be resiliently deflected to allow insertion and securement through the ring 20 and the chain 22. Alternately, other suitable methods of securement can be used. The links 22*a* of the chain 22 can be selected so that the chain 22 can have various suitable weights for example, 5 pounds per foot, and can be coated or encased in plastic or rubber. The plastic or rubber coating can prevent or minimize binding of the chain 22. The length of the chain 22 and weight desired can vary depending upon the exercise performed, and in one embodiment, the chain 22 can be about 18 inches long having common style links 22*a* and about 3.3 pounds per foot (total of about 5 pounds).

With the housing 51 secured to a bar 12, the cable 18 properly adjusted, and one end of the chain 22 clipped to the ring 20, a variable weight device 50 having a uniform chain 22 can allow a user 24 consistent gradual increasing and decreasing resistance during each repetition of an exercise movement, as the weight of more or less links 22*a* of chain 22 transfer from the ground 26 (or other base), and back again throughout a range of motion. The variable weight device 50 can encourage muscle response in a unique fashion, distinct from traditional "free weight" and "plate loaded" equipment which employ a consistent weight throughout an entire range of motion.

Weights 16 and chains 22 can be combined in different combinations to vary a user's 24 muscle load. Multiple strands of chain 22 can be combined side by side in parallel to a single housing 51 by clipping to ring 20 with clips 68 (FIG. 6) to increase weight within the prescribed range of motion, or can be connected end to end by clips 68 (FIG. 7) to accommodate movements requiring an increased range of motion, and increased weight.

A number of different exercises can be performed using variable weight device 50. For example, to execute a bench press using the variable weight device 50, two housings 51 can be slid onto the sleeve 14 at each end of the weight bar 12. Marked measurement indicators or markings 18*a* can allow cables 18 to be adjusted to equal length so that end rings 20 can touch the ground 26 at the projected bottom of the movement. Strands of flexible weight or chain 22 can be attached to their respective housing 51 by clipping a chain 22 to the ring 20, while the bar 12 remains on the bench press rack 9 (FIG. 1). As the user 24 lifts the bar 12 from the rack 9 and initiates the first repetition by extending the bar 12 upward from chest (bottom of movement), the weight will increase evenly on both sides as each subsequent link 22*a* of chain 22 lifts off the ground 26, and correspondingly decreases as the bar 12 is lowered from the top of the movement and the links 22*a* return in form to the ground 26. The variable weight device 50 can be used exclusively or in conjunction with weights 16.

In another example, squat exercises can be performed using the variable weight device 50. Squat exercises typically employ a rack that is higher than the bench press rack 9 since the user 24 lifts the weight bar 12 from a standing position and then squats down. If desired, fixed weights 16 can be slid onto the sleeve 14 at each end of the bar 12 and secured with housings 51. Cables 18 can be adjusted to equal length so that the rings 20 can touch the ground 26 at the projected bottom of the movement. Since the range of motion for a squat is longer than that of a bench press, strands of chain 22 can be clipped to one another end to end (FIG. 7), with one end of the extended chain 22 being clipped to its respective housing 51, while the bar 12 remains racked. As the user 24 lifts the bar 26 from the rack and initiates the first repetition by extending the bar 12 upward from a squatting position (bottom of movement), the fixed weight resistance remains constant while the variable weight device 50 adds weight evenly on both sides as each subsequent link 22*a* of chain 22 lifts off the ground 26, and correspondingly decreases as the bar 12 is lowered from the top of the movement and the links 22*a* return to the ground 26. It is understood that other exercises are also contemplated, and the weight bar 12 may be lifted from the ground 26 instead of from a rack.

Figures 6, 7, 8:
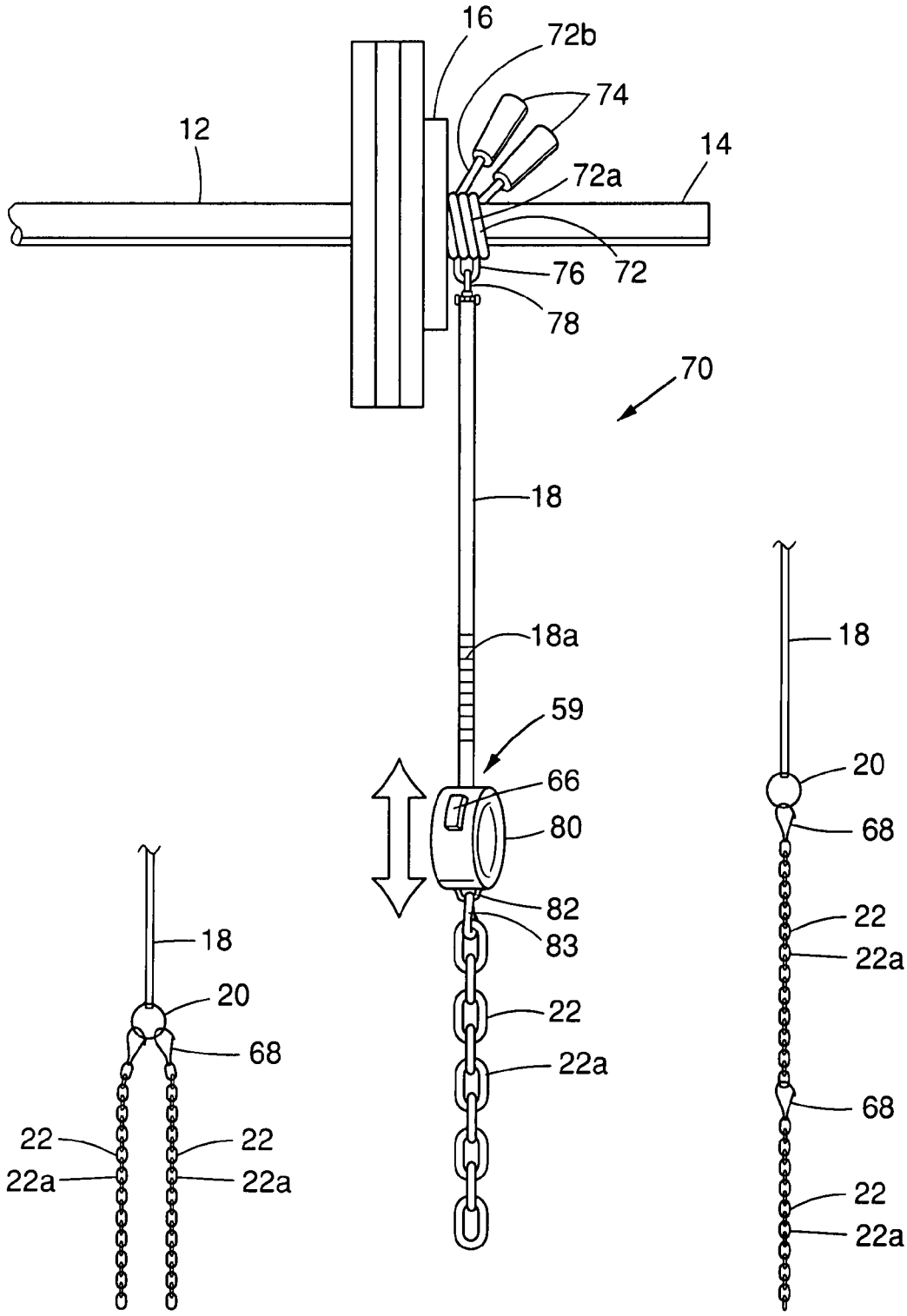
FIG. 6 is a side view depicting two lengths of chain secured side by side to a cable.
FIG. 7 is a side view depicting two lengths of chain secured end to end.
FIG. 8 is a side view of another embodiment of a variable weight device attached to a weight training bar.
Figure 9:
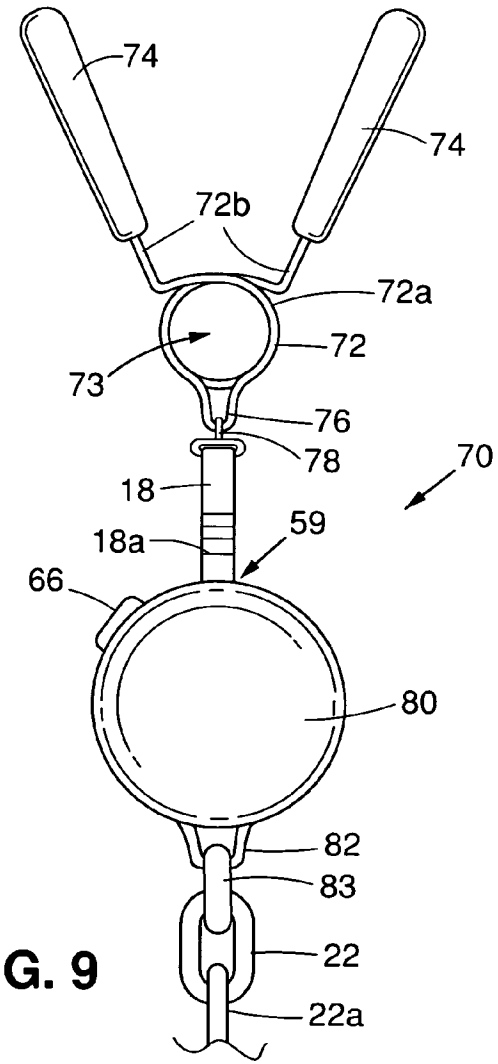
FIG. 9 is an enlarged front view of the variable weight device of FIG. 8.
Figure 11:
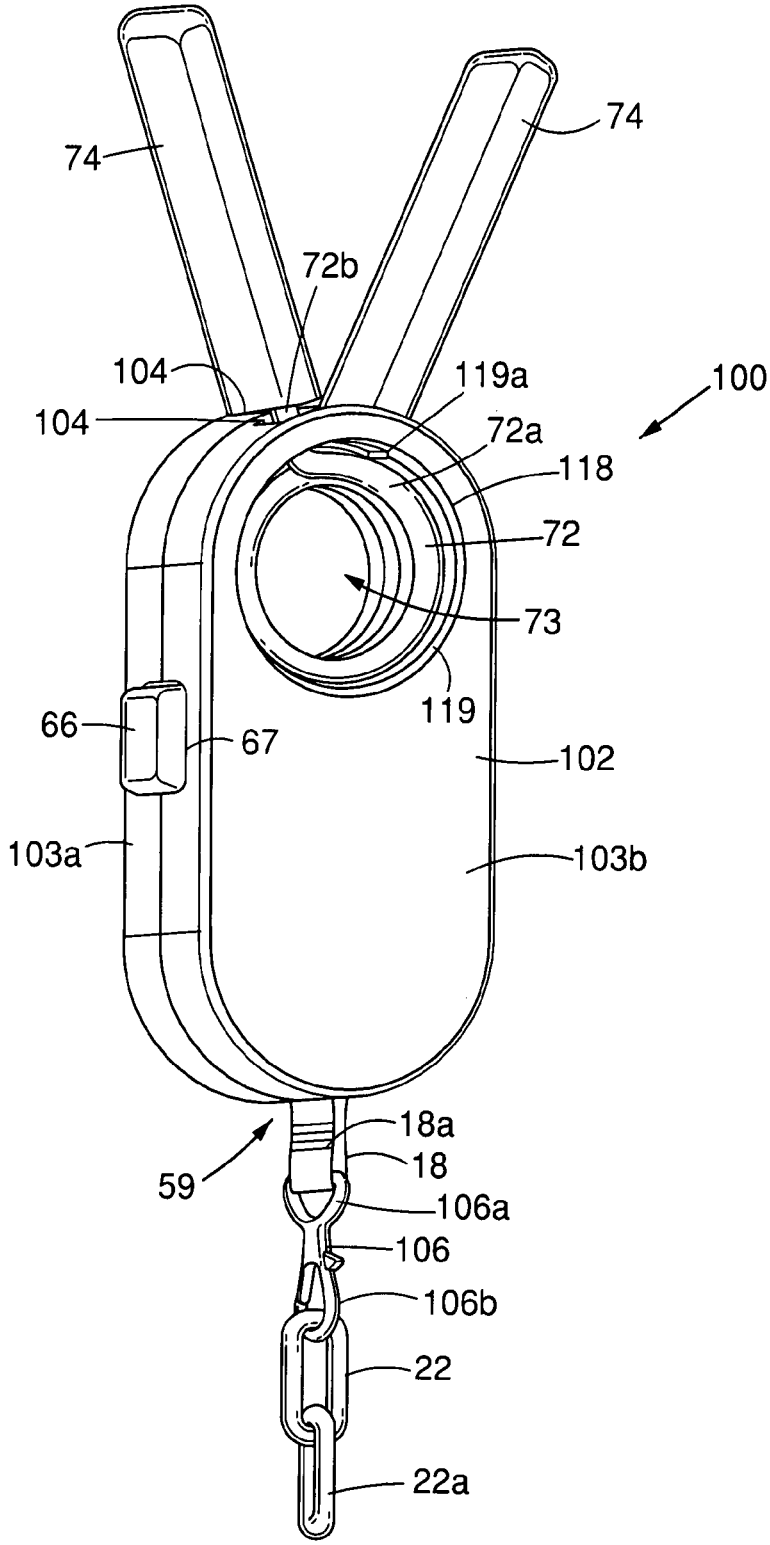
FIG. 11 is a perspective view of yet another embodiment of a variable weight device.
Figure 12:
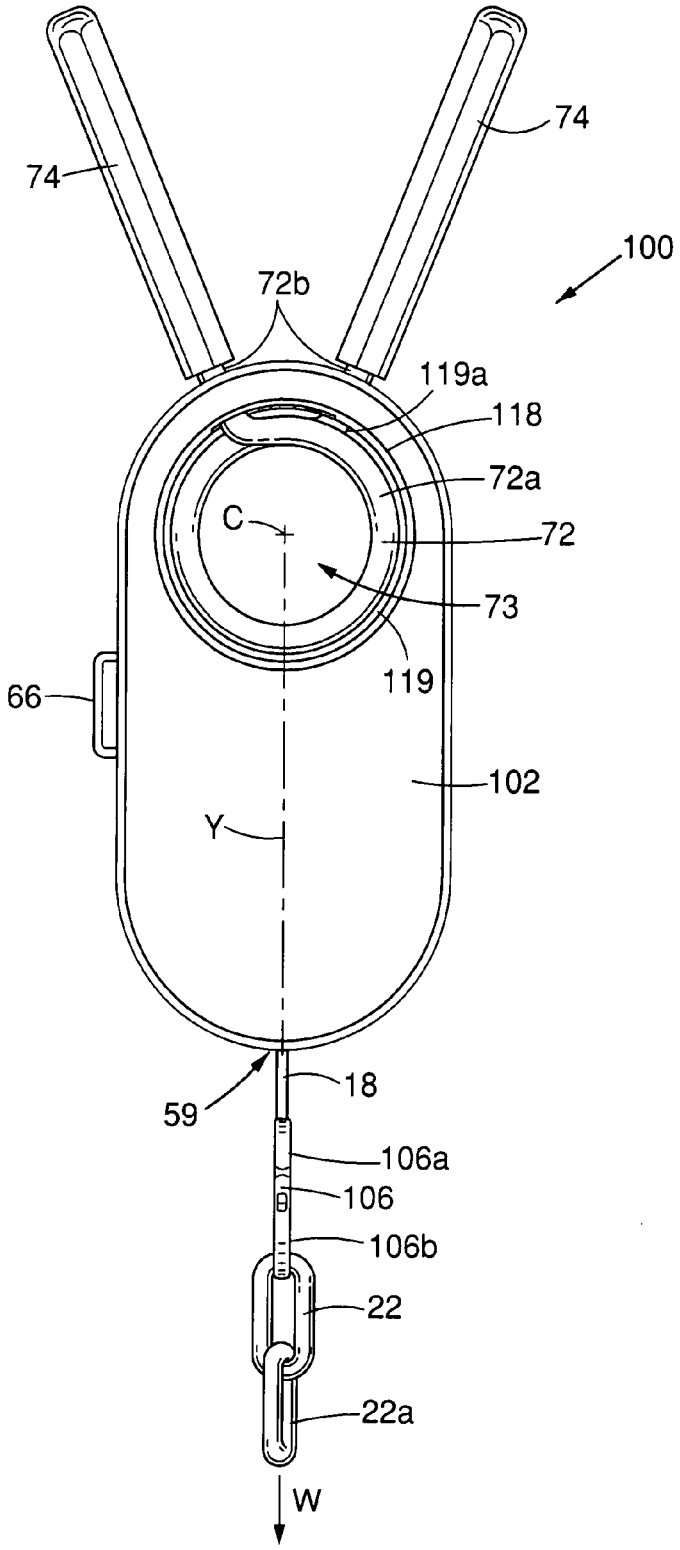
FIG. 12 is a front view of the variable weight device of FIG. 11.
Figure 13:
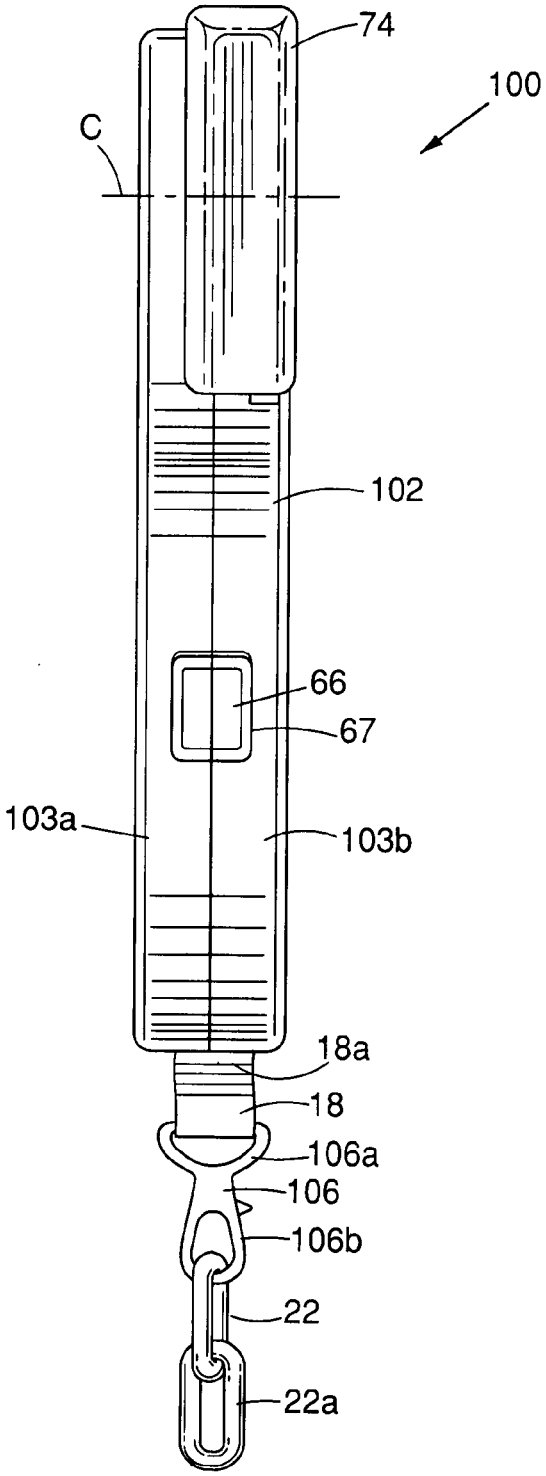
FIG. 13 is a side view of the variable weight device of FIG. 11.

Referring to FIGS. 8 and 9, variable, flexible or linked weight system, apparatus or device 70, can include a resilient helical spring loaded locking collar, clamp, cuff or sleeve 72, with a resilient expandable opening 73 for securing to the end sleeve 14 of a weight bar 12 or a suitable structure on an exercise device. The locking collar 72 can have handles or levers 74 connected to ends 72*b* extending from opposite axial ends of the spring collar helix or coil 72*a* of the locking collar 72. Squeezing the handles 74 together can resiliently expand the opening 73 for allowing the locking collar 72 to be placed onto or removed from the end sleeve 14. When the handles 74 are released, the opening 73 can resiliently shrink and can firmly resiliently grip the end sleeve 14 and lock weights 16 in place on the end sleeve 14.

Figure 14:
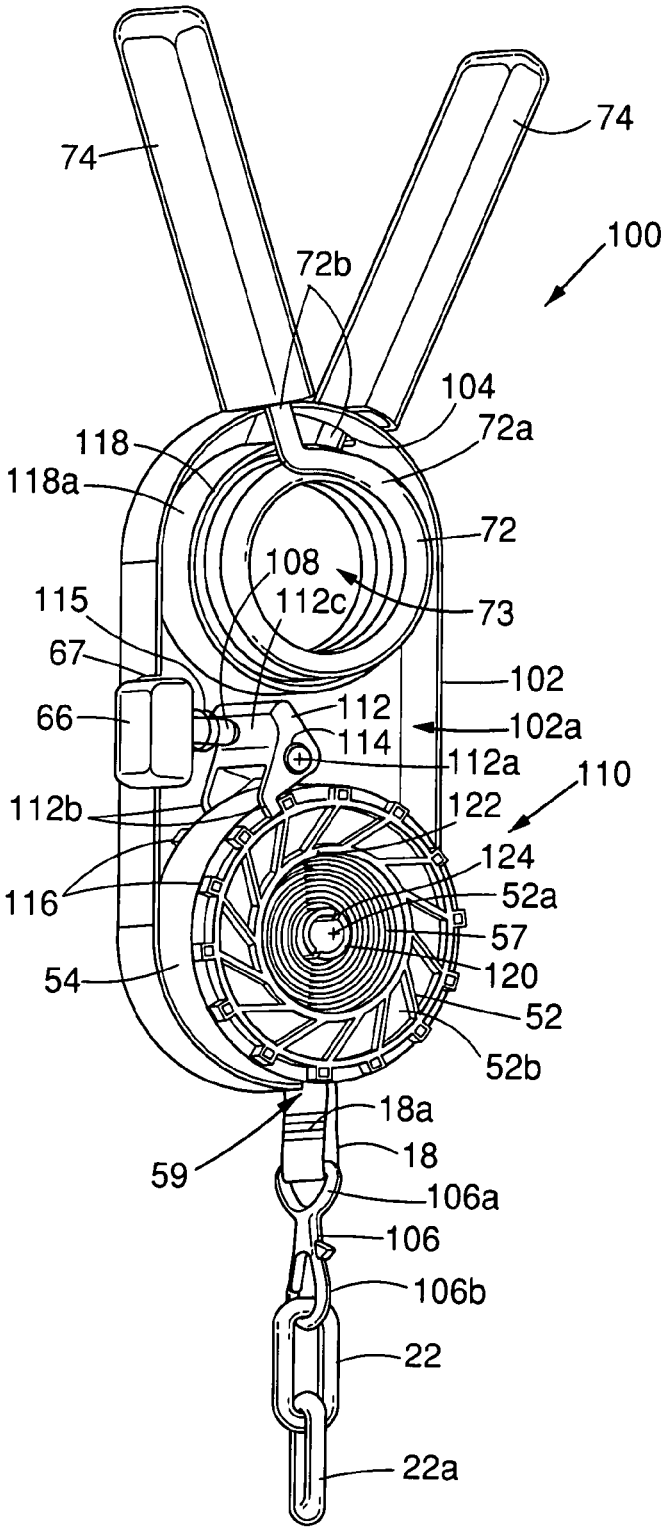
FIG. 14 is a perspective view of the variable weight device of FIG. 11 with a front portion of the housing removed.
Figure 15:
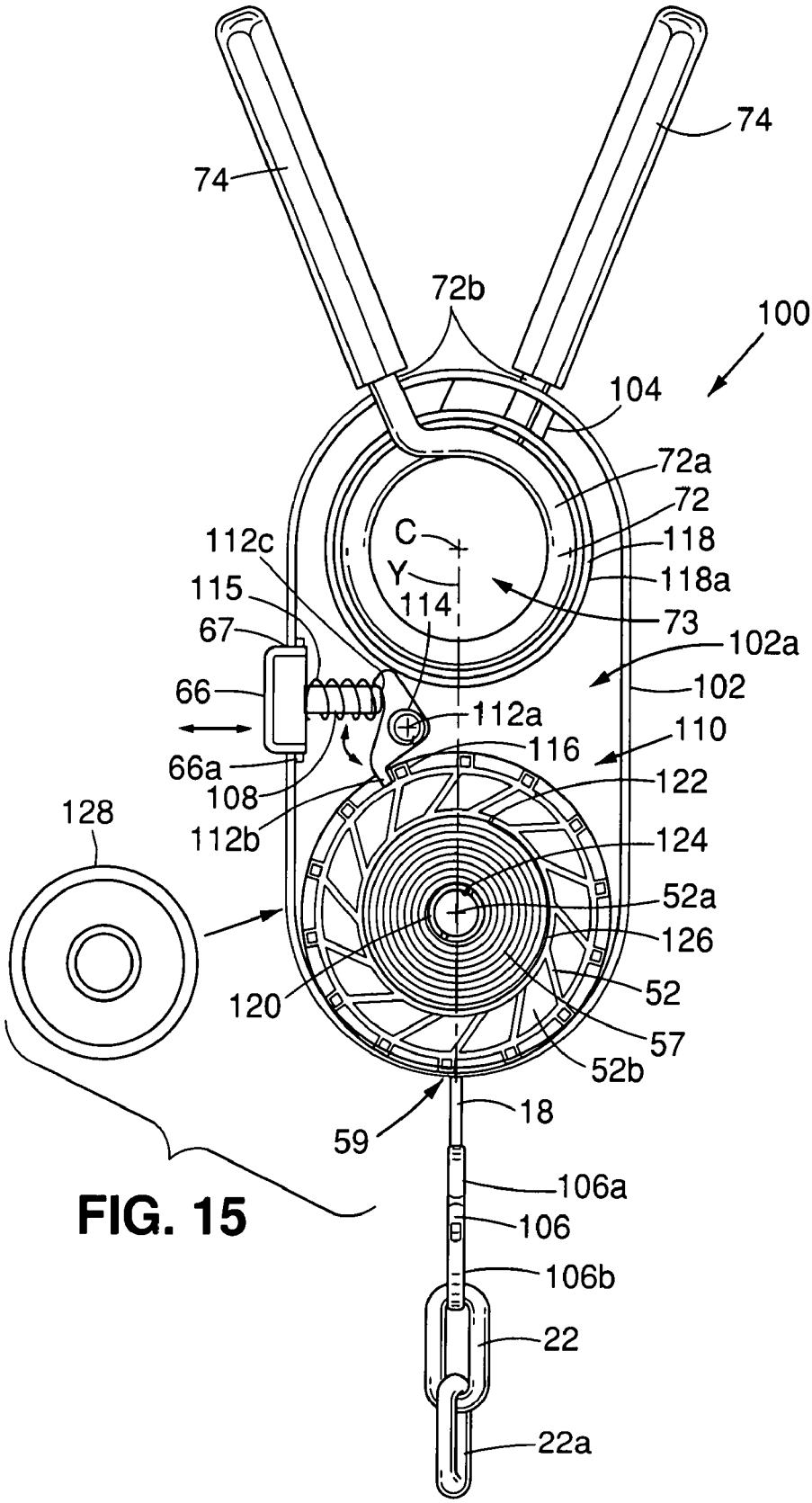
FIG. 15 is a front view of the variable weight device of FIG. 11 with a front portion of the housing removed.
Figure 16:
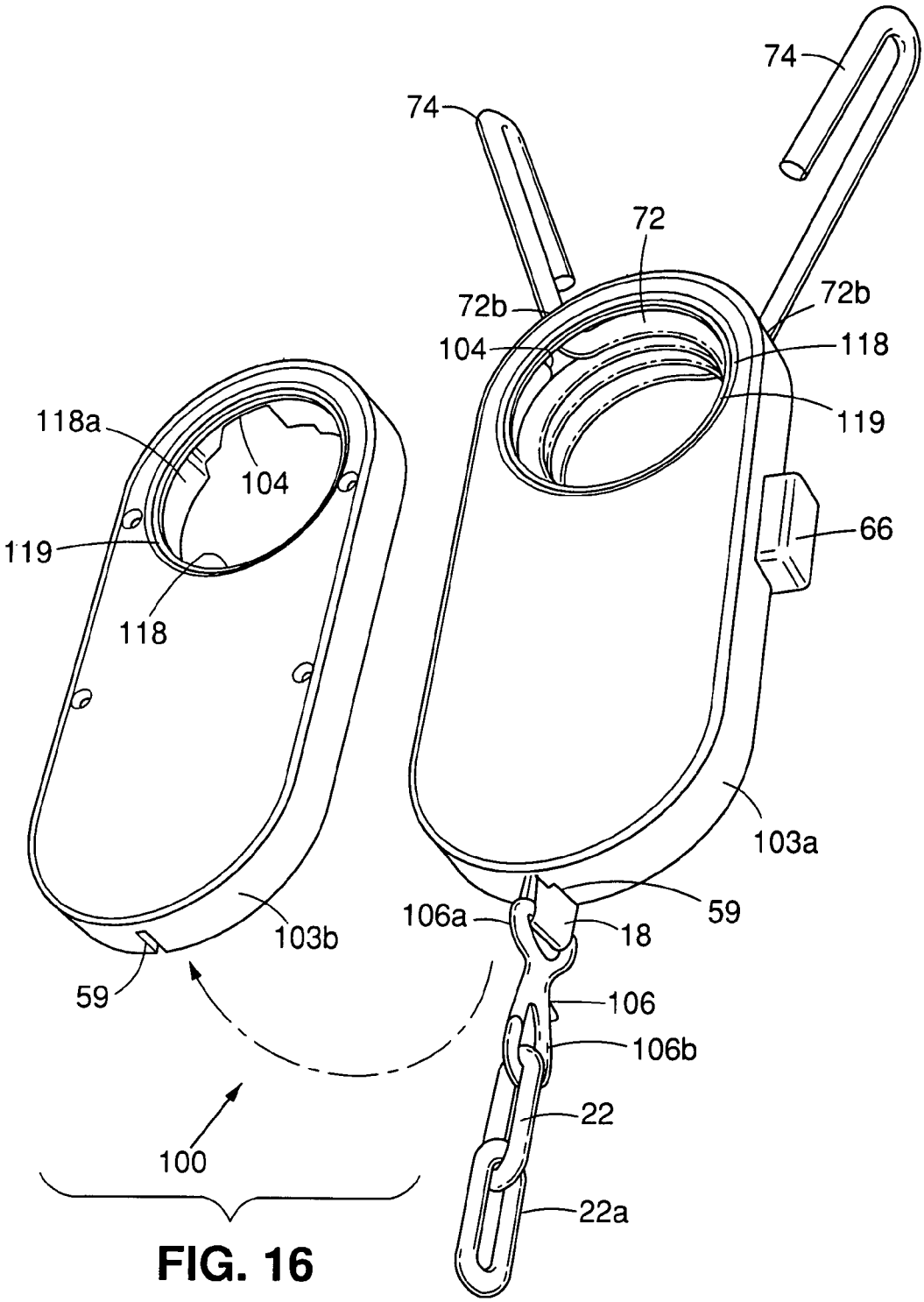
FIG. 16 is a perspective view of housing portions positioned side by side, with the covering on the handles of the locking collar omitted.

A housing 80 with an adjustable cable 18 can be adjustably connected to the locking collar 72 by the cable 18. The locking collar 72 can have a securement loop, ring or member 76 which the cable 18 can be secured to by a ring or clip 78. The housing 80 can have any suitable shape, and is shown to be generally disc shaped in FIGS. 8 and 9, as an example. The housing 80 can contain a lockable cable adjustment mechanism 55 for adjusting the cable 18, or any other suitable cable adjustment mechanisms, for example, lockable cable adjustment mechanism 110 (FIGS. 14 and 15). A length of flexible weight or chain 22 can be secured to the housing 80 by a ring or clip 83, which can engage or be connected to a loop, ring or member 82, extending or protruding from the housing 80 on the side opposite to opening 59.

Adjustment of the cable 18 can raise or lower the position of the housing 80 relative to the locking collar 72 and bar 12, which in turn can raise or lower the position or starting point of the chain 22, to adjust or obtain the desired weight increase/decrease characteristics.

Figure 10:
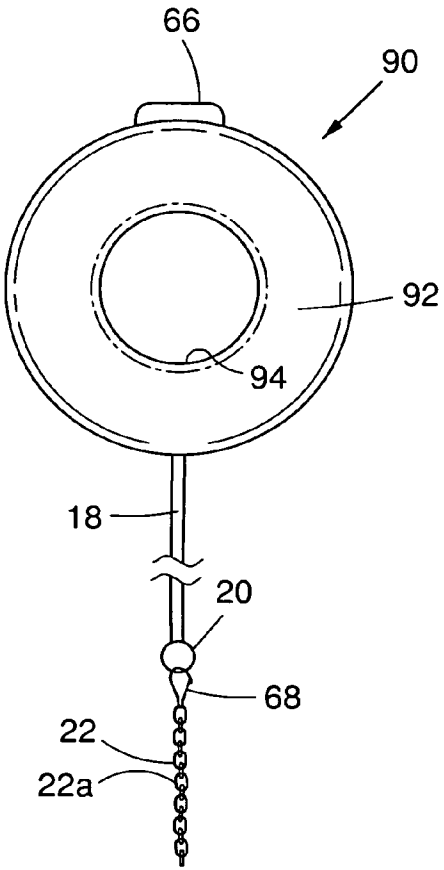
FIG. 10 is a front view of another embodiment of a variable weight device.

FIG. 10 depicts a variable, flexible or linked weight system, apparatus or device 90, which can be similar to variable weight device 50 and can have an annular cuff, collar or housing 92 with a central opening 94 for positioning onto an end sleeve 14 of a weight bar 12, or to an adapter 40 or other suitable structure. The central opening 94 does not have to be lockable as shown, but can include a locking device if desired. Variable weight device 90 can have a lockable cable adjustment mechanism 55 for adjusting the length of cable 18 and the position of the flexible weight or chain 22. Alternately, other suitable lockable adjustment mechanisms can be employed, for example, lockable adjustment mechanism 110.

Referring to FIGS. 11-16, variable, flexible or linked weight system, apparatus or device 100, can include a housing 102 with two halves or half portions 103*a* and 103*b*, that can include an opening, hole or passage 118, extending through the housing 102, for example, in the lateral direction. The opening 118 can be surrounded or bounded by a wall 118*a*, and can be for example, circular in shape. A locking collar 72 can be positioned within the housing 102 with the spring collar helix or coil 72*a* being positioned within the opening 118 along a common central axis C (FIGS. 12 and 15) with the outer diameter being close or adjacent to the wall 118*a*. A pair of annular wear bearings, rings or members 119 can be positioned within the wall 118*a* on opposite axial sides or ends of the coil 72*a* to provide bearing or slide surfaces, and can axially trap the coil 72*a* in position. The ends 72*b* of the spring coil 72*a* can extend through the wall 118*a* and the housing 102, through passages or openings 104 which capture the ends 72*b* and are sized to allow handles 74 to be squeezed towards each other to allow operation of the locking collar 72, for example, as previously described, for securement to an end sleeve 14 of a weight bar 12 or other suitable structure on an exercise device. The members 119 can have surfaces that face and contact the opposite axial ends of the coil 72*a* that are inclined at the angle of the helix of the coil 72*a*, and can have a notch or step 119*a* that lines up with the edge of the openings 104. The combination of the wall 118*a*, members 119 and the passages 104 can hold or capture the locking collar 72 in position relative to the housing 102.

A lockable cable adjustment mechanism 110 can be positioned within the interior 102*a* of the housing 102 adjacent to or below the locking collar 72 and the passage 118. The lockable cable adjustment mechanism 110 can include a supply spool 52 having a supply 54 of cable 18. The supply spool 52 can be rotatably lockable about axis 52*a* and can be positioned on an axle or pivot 120. The supply spool 52 can be resiliently spring loaded by a spring mechanism 57, for example, a wound spring positioned within cavity 126 of the supply spool 52. One end 122 of the spring mechanism 57, for example, on the outer perimeter, can be secured to the wall of the cavity 126 and the other end 124 of the spring mechanism 57, for example, on the inner portion, can be secured to the axle 120. Securement of the ends 122 and 124 can be provided by protrusions or openings on the wall of the cavity 126 and axle 120. The spring mechanism 57 can be covered by a cover 128 which can snap in place within cavity 126. The perimeter of the supply spool 52 can include pairs of spaced apart locking protrusions, teeth or structures 116, on opposite spool sides or faces 52*b* of the supply spool 52. The locking protrusions 116 can straddle the supply 54 of cable 18, and can be engaged by mating spaced apart pairs of locking fingers or protrusions 112*b* on a locking member 112. The locking member 112 can be resiliently pivotably biased about a pivot 112*a* by a spring 114, for example, a torsion spring, for causing the protrusions 112*b* to engage the locking protrusions 116 on the supply spool 52 to lock the supply spool 52 in place. The supply spool 52 can be rotatably unlocked by pressing button 66 inwardly. The button 66 can extend through an opening 67 in the housing 102 and can be resiliently biased outwardly by a spring 115. A rim or protrusion 66*a* on the button 66 (FIG. 15) can engage the inside of the housing 102 and hold the button 66 within the housing 102. Depression of the button 66 can cause a protrusion 108 extending from the button 66 to engage locking member 112 on a surface 112*c* that is located on the opposite side of the pivot 112*a* from the locking protrusions 112*b*. This can pivot the locking member 112 about the pivot 112*a*, causing the locking protrusions 112*b* to disengage from the locking protrusions 116 on the supply spool 52. As a result, the cable 18 can be resiliently pulled from the supply spool 52 through the opening 59 in the housing 102 to lengthen the cable 18 relative to housing 102. Alternatively, the spring mechanism 57 can be allowed to pull the cable 18 into the housing 102 and be wound onto the supply spool 52 to shorten the cable 18. The spring 115 can be omitted and the button 66 can be resiliently biased outwardly by spring 114 via surface 112*c*. In addition, the torsion spring 114 can be replaced by an extension or compression spring.

The cable 18 can be attached to the flexible weight or chain 22 by a clip 106. The clip can have one ring 106*a* for securing or connecting to the cable 18, and another ring 106*b* for connecting to the chain 22 through one of the links 22*a*. One or both rings 106*a* and 106*b* can have spring loaded members for opening and closing the rings 106*a* and 106*b*. Alternatively, the cable 18 can be connected to the chain 22 by other suitable means.

The housing 102 can be generally elongate in shape vertically or along axis Y (FIGS. 12 and 15), and can have curved ends. Alternatively, the housing 102 can have a generally round perimeter. The housing 102 can be made of plastic, with the halves 103*a* and 103*b* held together by screws but alternately, can be formed of other suitable materials such as composites or metals. The housing 102 can be assembled and held together in other suitable manners. The weight W of the chain 22 can be supported by the housing 102. The interior of the housing 102 can have internal ribs for structural strength. The supply spool 52 and the opening 59 through which the cable 18 passes, can be positioned below the locking collar 72 along vertical axis Y, to provide variable weight device 100 with stability since the weight W of the chain 22 is directed centrally downwardly relative to axis C. The opening 59 can be located inline with axes C and Y so that the weight W of the chain 22 (FIG. 12) does not cause the housing 102 to spin or rotate when positioned on a sleeve 14 of a weight bar 12, or cause the sleeve 14 or bar 12 to spin. Variable weight device 100 can be employed in a manner similar to those previously discussed above with regard to other embodiments.

Figure 17:
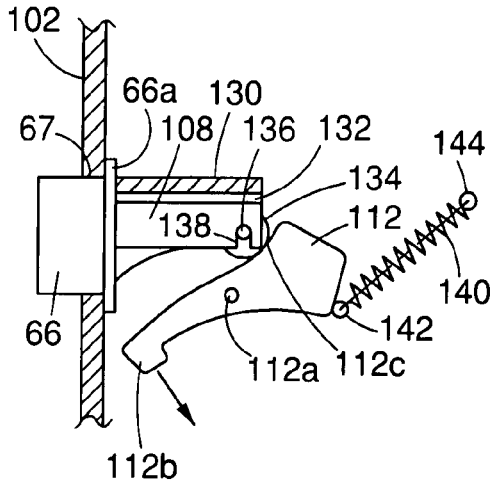
FIG. 17 is a schematic view of another embodiment of a push button and locking member arrangement.
Figure 18:
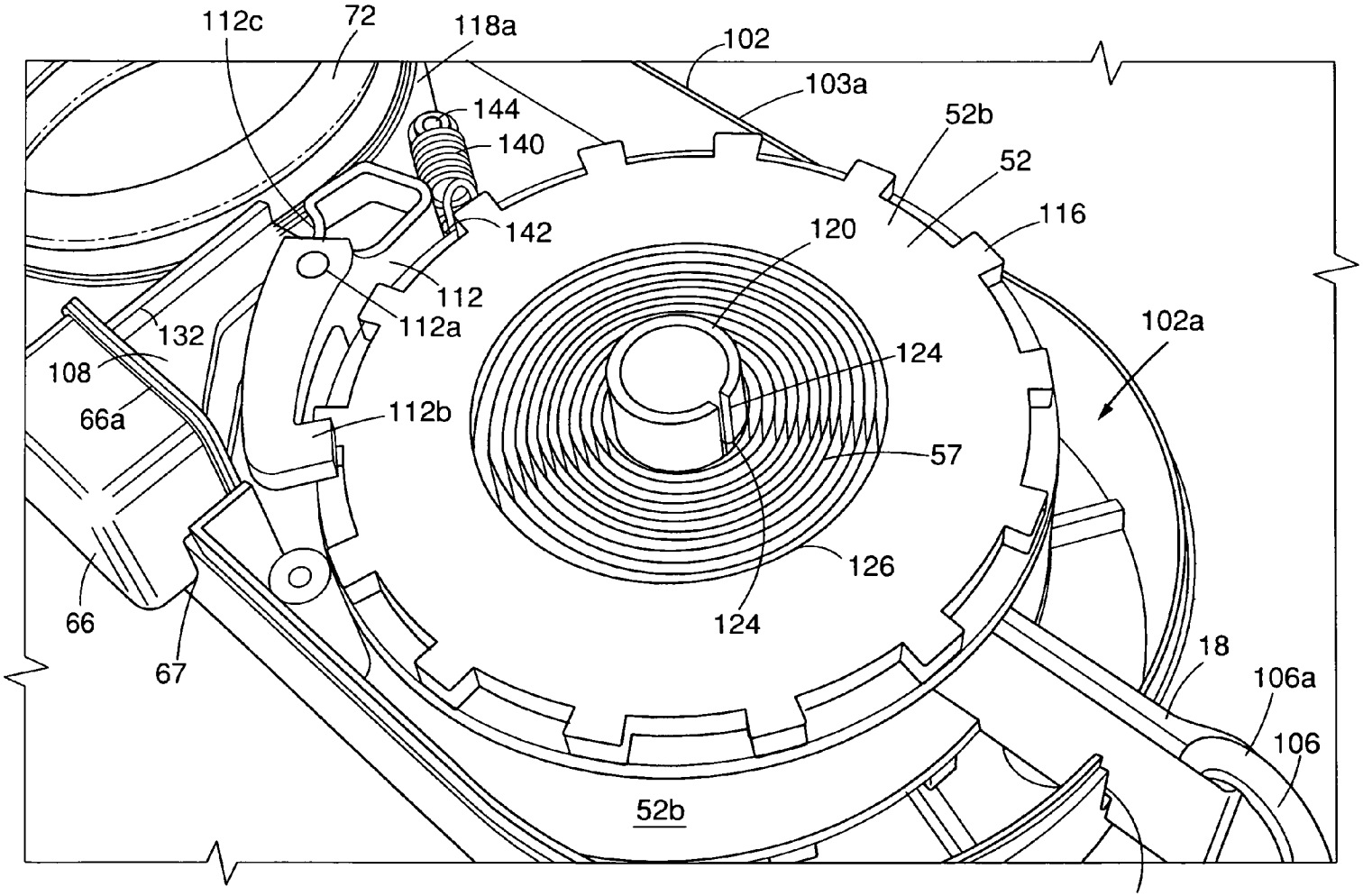
FIG. 18 is a perspective view of the variable weight device of FIG. 11 having the locking mechanism of FIG. 17.
Figure 19:
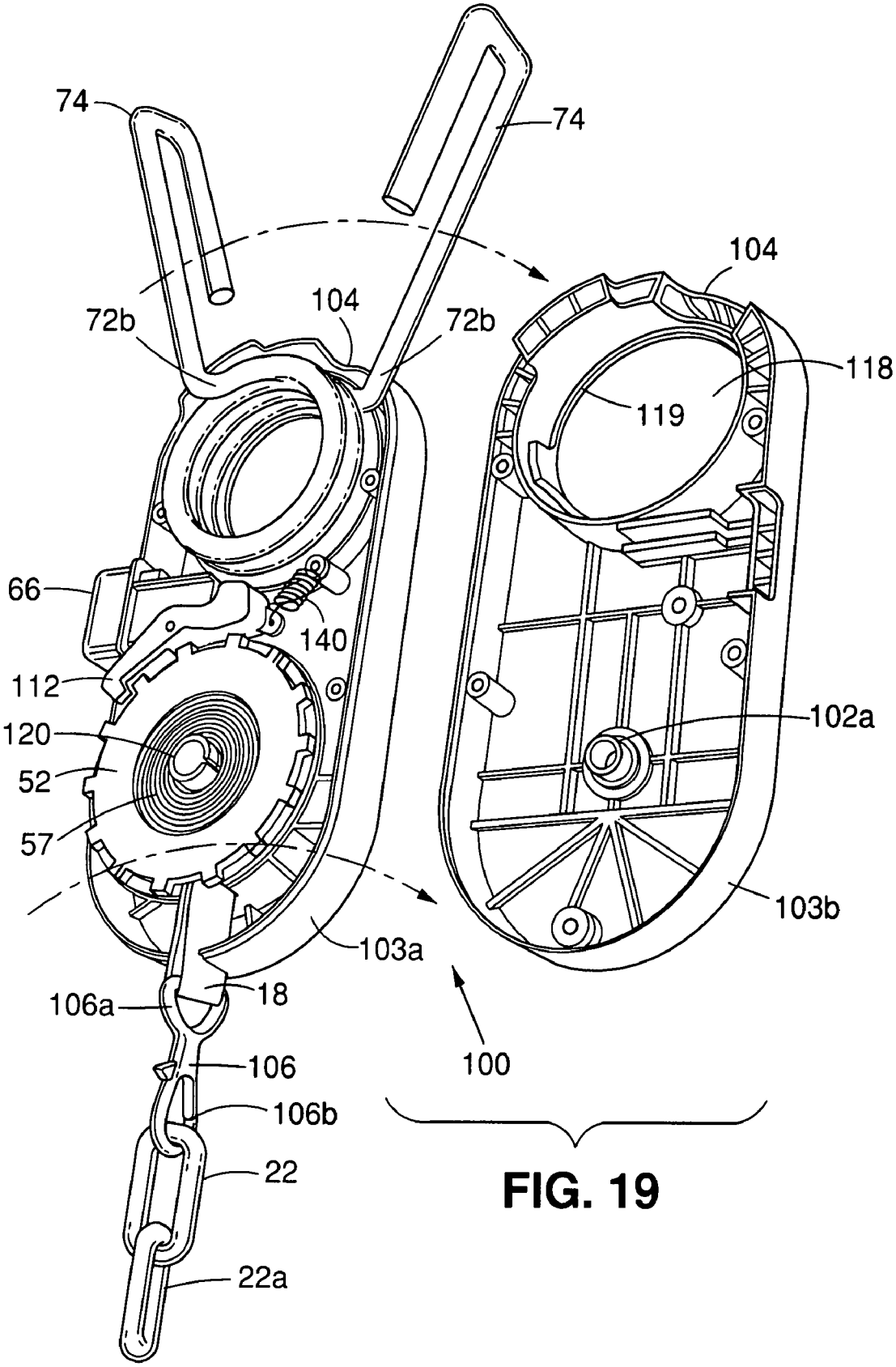
FIG. 19 is a perspective view of the interior of the housing portions of the variable weight device of FIG. 11 and having the locking mechanism of FIG. 17, the covering on the handles of the locking collar omitted.

Referring to FIGS. 17-19, in another embodiment, the locking member 112 can be rotatably biased about pivot 112*a* by an extension spring 140 secured to an attachment or anchor point 144 on the housing 102 and to an attachment or anchor point 142 on the locking member 112. The button 66 can have a linear sliding surface 132 which slidably engages a mating slide track or structure 130 on the housing 102 for slidably mounting the button 66. The protrusion 108 can have a roller 134 for engaging surface 112*c* on the locking member 112. The roller 134 can have an axle or pivot 136 which can snap into a slot 138 within protrusion 108. The extension spring 140 can resiliently bias the button 66 against the housing 102. Protrusions 66*a*, such as a rim, can provide a stop for the button 66 so that the button can be held within the housing 102. In particular embodiments, the housing portion 103*b* can have a mating axle portion 102*a* (FIG. 19) for engaging axle 120.

While this invention has been particularly shown and described with references to example embodiments thereof, it will be understood by those skilled in the art that various changes in form and details may be made therein without departing from the scope of the invention encompassed by the appended claims.

For example, various features of the embodiments shown and described can be omitted or combined together. In addition, although the chain 22 has been described to provide gradual weight increase/decrease, the chain 22 can be replaced with a single weight for a rapid and sudden weight increase/decrease, or a series of large weights connected together. Furthermore, embodiments of the present invention can be used on exercise devices that normally do not have weights attached or as an alternative to using weight plates on a bar or on an exercise machine stack. Although some securement members have been described as being spring loaded, in some embodiments, set screws can be employed as securement members. Also, although particular adjustment and locking mechanisms have been shown and described, other suitable mechanisms and arrangements can be employed.

What is claimed is:

1. A method of adjusting a length of flexible weight on an exercise device comprising:

storing flexible cable within a housing, a length of the cable extending from the housing with the length being adjustable;

securing the length of flexible weight to one of the housing and the cable, providing at least a portion of the length of flexible weight on a surface, the length of flexible weight being configured for incremental lifting upwardly off surface for providing incrementally increasing total lifted weight during an exercise motion; and adjusting the length of the cable to adjust the position of the length of flexible weight.

2. The method of claim 1 further comprising securing the housing to the exercise device with a securement arrangement.

3. The method of claim 2 further comprising securing the housing to a bar member of the exercise device through an opening through the housing.

4. The method of claim 2 further comprising securing the variable weight device to a bar member of the exercise device with a spring loaded collar.

5. The method of claim 1 further comprising:

storing a supply of the cable on a lockable spring loaded spool of an adjustable cable mechanism; and releasably locking the spool with a locking mechanism.

6. The method of claim 5 further comprising adjusting the cable according to adjustment markings on the cable.

7. The method of claim 6 further comprising securing the housing to a weight bar through an opening in the housing above the spool, the opening including a spring loaded collar.

8. The method of claim 1 further comprising employing chain as the length of flexible weight.

9. A method of adjusting a length of flexible weight on an exercise device comprising:

securing a housing to the exercise device, the length of flexible weight being connected to the housing, providing at least a portion of the length of flexible weight on a surface, the length of flexible weight being configured for incremental lifting upwardly off the surface for providing incrementally increasing total lifted weight during an exercise motion, the housing containing an adjustment mechanism; and lockably adjusting the position of the length of flexible weight relative to the exercise device to provide different starting points for incrementally lifting the length of flexible weight for providing increasing and decreasing weight throughout a range of motion.

10. A method of providing variable weight on an exercise device comprising:

providing a housing;

securing the housing to the exercise device with a securement arrangement, the securement arrangement including a spring loaded collar within the housing; and connecting a length of flexible weight to the housing, providing at least a portion of the length of flexible weight on a surface, the length of flexible weight being configured for incremental lifting upwardly off the surface for providing incrementally increasing total lifted weight during an exercise motion.

11. A method of adjusting a variable weight device on an exercise device comprising:

securing the variable weight device to a structure on the exercise device with a securement arrangement;

providing an adjustable cable mechanism connected to the securement arrangement, the adjustable cable mechanism having a housing containing an adjustably retractable cable capable of being adjustably locked to adjust the cable extending from the housing to a desired length;

connecting a length of flexible weight to the adjustable cable mechanism, providing at least a portion of the length of flexible weight on a surface, the length of flexible weight being configured for incremental lifting upwardly off the surface for providing incrementally increasing total lifted weight during an exercise motion; and adjusting the length of the cable extending from the housing to adjust position of the length of flexible weight.

* * * * *

UNITED STATES PATENT AND TRADEMARK OFFICE

CERTIFICATE OF CORRECTION

PATENT NO. : 7,841,970 B2
APPLICATION NO. : 11/880470
DATED : November 30, 2010
INVENTOR(S) : Michael Striar and Stephen Charles Messer It is certified that error appears in the above-identified patent and that said Letters Patent is hereby corrected as shown below:

Column 10, Claim 1, line 11, insert --the-- before the word "surface".

Signed and Sealed this
Fifteenth Day of February, 2011

David J. Kappos

David J. Kappos
*Director of the United States Patent and Trademark Office*